US005971796A

United States Patent [19]

Duhr

[11] Patent Number: 5,971,796

[45] Date of Patent: Oct. 26, 1999

[54] WIRE HARNESS AND CONNECTOR SHROUD

[75] Inventor: Jerome Adam David Duhr, Westland, Mich.

[73] Assignee: Yazaki Corporation, Japan

[21] Appl. No.: 09/089,327

[22] Filed: Jun. 2, 1998

[51] Int. Cl.[6] ..... H01R 13/56

[52] U.S. Cl. ..... 439/445; 439/364

[58] Field of Search ..... 439/445, 364, 439/247, 248, 447, 465, 559

[56] References Cited

U.S. PATENT DOCUMENTS

| | | | |
|---|---|---|---|
| 5,000,693 | 3/1991 | Hatagishi et al. . | |
| 5,104,333 | 4/1992 | Hatagishi et al. | 439/559 |
| 5,139,431 | 8/1992 | Saito et al. | 439/364 |
| 5,160,811 | 11/1992 | Ritzmann . | |
| 5,300,734 | 4/1994 | Suzuki | 439/445 |
| 5,621,328 | 4/1997 | Yamanashi | 439/559 |
| 5,788,529 | 8/1998 | Borzi et al. | 439/364 |

*Primary Examiner*—Michael L. Gellner
*Assistant Examiner*—Antoine Ngandjui
*Attorney, Agent, or Firm*—Young & Basile PC

[57] ABSTRACT

A shroud for securing a wire harness and its attached connector to a electrical power distribution center (PDC) assembly. The shroud surrounds the end of the wire harness and engages the wire harness connector so as to permit a degree of linear movement of the connector relative to the shroud. The shroud is secured to a PDC housing to place the connector in alignment with a mating connector on a PDC, and a bolt passing through the mating connector is tightened into engagement with a nut molded into the wire harness connector to draw the wire harness connector into electrical connection with the mating connector.

17 Claims, 4 Drawing Sheets

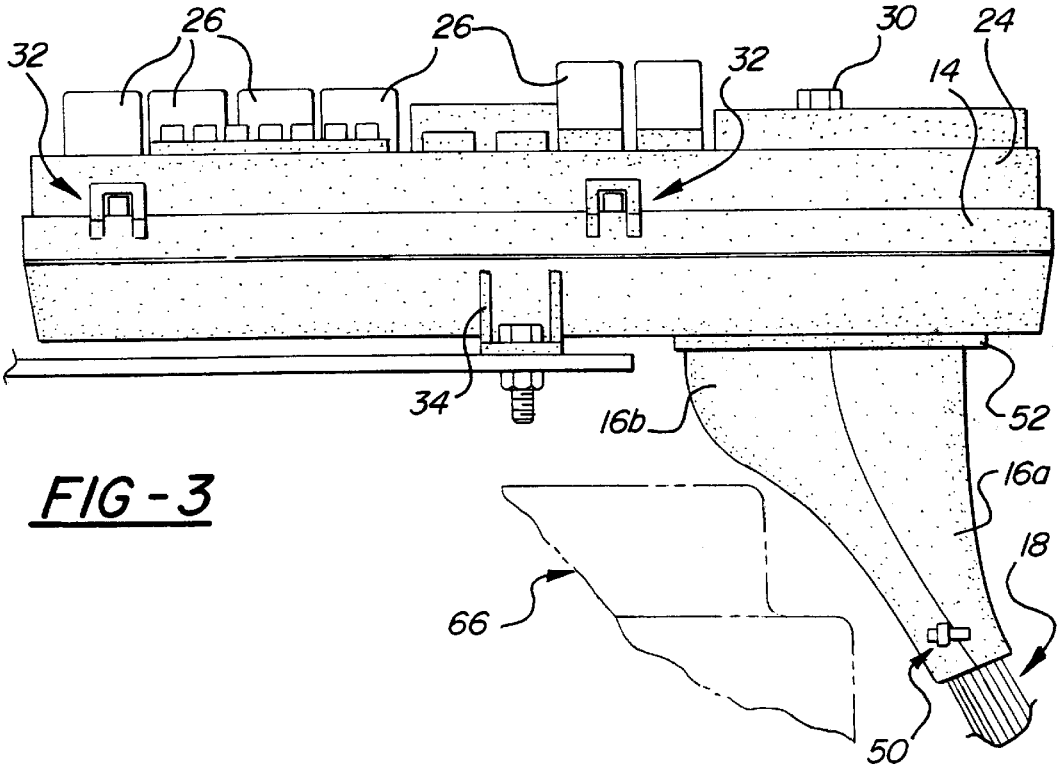
FIG-3
FIG-4
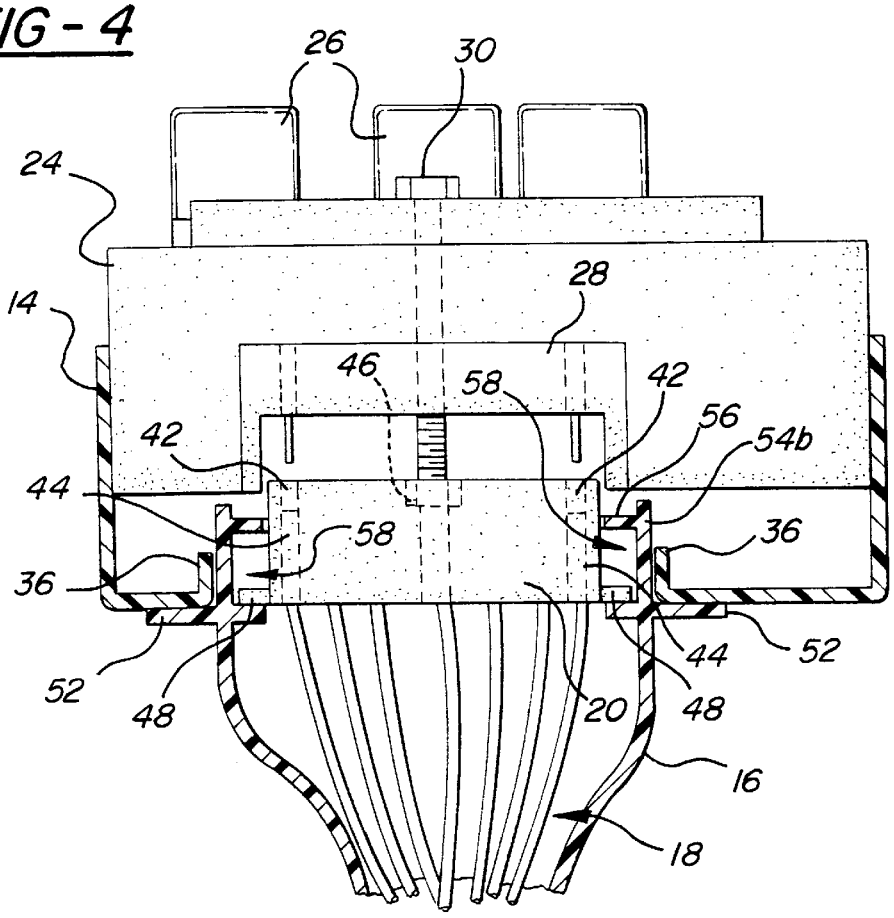

WIRE HARNESS AND CONNECTOR SHROUD

FIELD OF THE INVENTION

This invention is directed toward a shroud for surrounding an end of a wire harness and securing the wire harness to a power distribution center such that a connector attached to the end of the harness is in alignment with a mating connector on the power distribution center and may be connected thereto.

BACKGROUND OF THE INVENTION

Power distribution centers (PDCs) are commonly used in automotive vehicles to simplify electrical system wiring by eliminating multi-branch wiring and consolidating fuses, relays, and other electrical components in a single location. A PDC typically comprises a plastic case having receptacles on its upper surface for receiving the electrical components and containing bus bars or other conductive means for interconnecting and supplying power to the various components. Electrical connectors are also disposed on the upper surface of the PDC, these mating with the connectors which terminate wire harnesses to interconnect the circuitry of the PDC with various vehicle electrical systems and devices elsewhere in the vehicle. Some of the wire harness connectors are quite large. A typical engine harness connector, for example, may contain approximately 45 terminals and measure five centimeters by six centimeters. A large wiring harness connector is usually secured to its mating connector on the PDC by means of a nut-and-bolt connection in which captive bolt passes through the center of the wiring harness connector and is threaded into a nut molded into the mating connector. Tightening the bolt urges the two connectors into electrical contact with one another, an operation that may otherwise be difficult to achieve due to the large insertion forces that accompany connectors with large numbers of terminals.

PDCs are often located within the engine compartment of the vehicle, and so are fitted with upper and lower housings to protect the PDC from contaminants such as dirt, water and other debris that may be present. The lower housing is typically bolted or otherwise secured to some structure within the engine compartment and thus serves as a mounting bracket for the PDC. The upper housing is usually removable to provide access to the circuit components on the PDC.

As the number of vehicle electrical systems has increased, it has become necessary in many cases to connect wire harnesses to the lower surface of the PDC. It is the general practice in the automotive industry to assemble the PDC prior to shipping it to a vehicle assembly plant for installation in the vehicle. At this point the necessary wire harness connections are made to the PDC. Because of the limited amount of space in most engine compartments, it may be difficult or impossible to reach the bottom of the PDC and make such connections after the PDC has been secured in place. If the connections must be made to the bottom of the PDC prior to securing it in the engine compartment, the assembly person must hold the PDC upside down, position the wire harness connector in alignment with the mating connector, and drive the captive bolt into engagement with the nut. This procedure is very awkward and time consuming, and increases the chance of accidental damage to the components.

An alternative assembly method is to connect the wire harnesses to the lower surface of the PDC prior to shipment to the final assembly plant. This is not desirable because the resulting assembly is quite large and cumbersome, and so is difficult to handle and install in the vehicle.

SUMMARY OF THE INVENTION

It is an object of this invention to provide a shroud for surrounding the end of a wire harness and attached wire harness connector and securing them to a housing of an electrical power distribution center (PDC) such that the connector may be quickly and easily inserted into mating connection with an electrical connector on the PDC.

A further object of the invention is to provide a wire harness shroud for protecting the harness from environmental contaminants and routing it in a desired direction.

A further object of the invention is to provide a PDC assembly and wire harness wherein a shroud surrounds the end of the wire harness and its attached connector and is secured to a PDC housing having an opening in a surface thereof to permit the wire harness connector to make electrical contact with a mating connector on the PDC.

According to the invention, the shroud has an open first end for receiving the wire harness connector and an open second end through which the wire harness exits. The shroud has means for engaging the connector to retain it in connection with the shroud yet permit the connector a degree of linear movement relative to the shroud. The shroud also has means for securing it to the housing in a position wherein the wire harness connector is placed in alignment with the mating connector on the PDC such that the wire harness connector may be moved into electrical connection with the mating connector.

In a preferred embodiment of the invention described and depicted herein, the shroud comprises two shell-like halves which snap into engagement with one another around the wire harness and the wire harness connector. The end of the shroud which surrounds the connector has a peripheral flange which is inserted into an opening in the PDC housing. The flange has a plurality of apertures formed therein which are engaged by latch projections on the housing to secure the shroud in connection therewith. When the shroud is secured to the housing, the wire harness connector is positioned in close proximity and direct alignment with the mating connector on the PDC. A lip extends outwardly from the flange around the entire periphery thereof to overlap the surface of the housing around the opening when the shroud is secured thereto, thereby creating a substantially contaminant-proof seal between the shroud and the housing.

Channels are formed in the inner surface of the flange and retain small tabs extending outwardly from the wire harness connector when the shroud halves are joined with one another, thereby trapping the connector in engagement with the shroud. The channels are deep in relation to the thickness of the tabs so that the wire harness connector may move vertically the distance required to achieve electrical connection between the wire harness connector and the mating connector. When the shroud is secured to the housing, a bolt passing through the center of the mating connector is aligned with a nut molded into the wire harness connector such that during assembly the bolt may be turned to threadingly engage the nut and draw the wire harness connector upwardly into contact with the mating connector.

According to another feature of the invention, the open end of the shroud fits closely around the outer periphery of the wire harness connector except for a U-shaped bulge which bows outwardly, away from the outer surface of the connector. This U-shaped section forms a wire bypass channel allowing one or more wires of the wire harness to enter the housing so that they may be connected to the PDC other than through the mating connector.

BRIEF DESCRIPTION OF THE DRAWINGS

FIG. 3 is a side view of the apparatus of FIG. 1;

FIG. 4 is a cross-sectional view taken along line 4—4 of FIG. 1 with the wire harness connector disconnected from the mating connector;

DESCRIPTION OF THE PREFERRED EMBODIMENT

Figure 1:
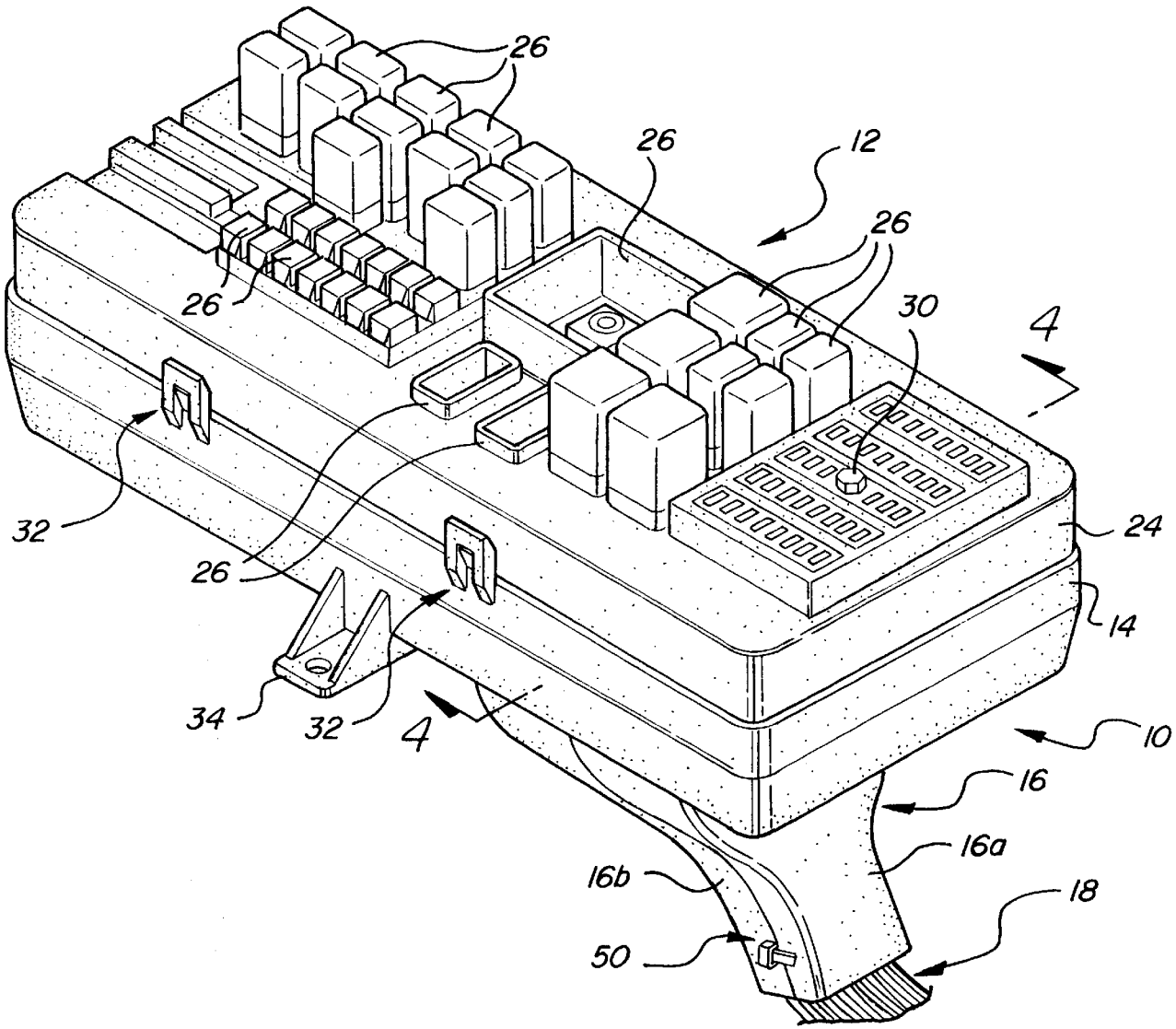
FIG. 1 is a perspective view of a shroud according to the present invention along with a power distribution center assembly and wire harness.
Figure 2:
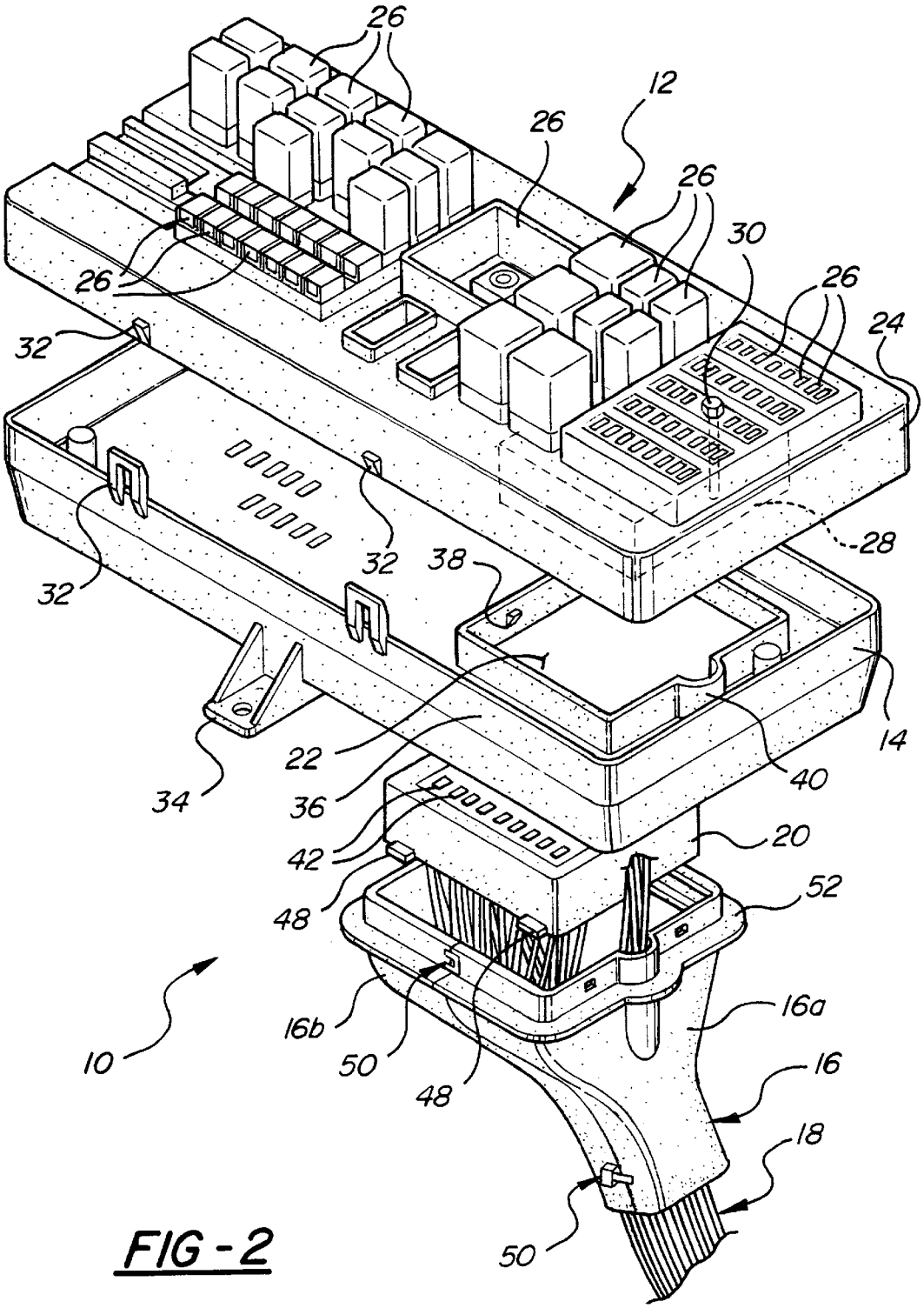
FIG. 2 is an exploded view of the apparatus of FIG. 1.

In FIGS. 1–5, a power distribution center (PDC) assembly 10 is shown to include a PDC 12, a lower PDC housing 14 and a wire harness shroud 16 connected to the lower housing. A wiring harness 18 and its attached wiring harness connector 20 make electrical contact with the underside of the PDC 12 by passing upwardly through the shroud 16 and an opening 22 in the underside of the lower housing 14, as is described in further detail hereinbelow.

The PDC 12 is generally conventional in construction in that it comprises a molded plastic case 24 having an upper surface on which are mounted electrical components 26 such as fuses, relays and electrical connectors. The case 24 contains bus bars or other conductive means (not shown) for supplying power to the various components 26 and connecting them into their respective circuits. The PDC 12 has a large, multi-pin connector 28 disposed on its lower surface (see FIGS. 4 and 5). A bolt 30 extends vertically through the approximate center of the connector 28, the bolt head being accessible on the top surface of the PDC 12.

The PDC 12 is secured in connection within the lower housing 14 by interlocking latching means 32 disposed in corresponding positions on the sides thereof. The lower housing 14 encloses the lower surface of the PDC 12 to protect it against contamination, and one or more mounting brackets 34 are formed integrally with the lower housing to provide points at which the PDC assembly 10 is bolted or otherwise fastened in its operative position within, for example, a vehicle engine compartment. An opening 22 is formed in the lower housing 14 and a peripheral wall 36 surrounds the opening, extending a short distance above the lower wall of the housing 14. Latching projections 38 jut inwardly from the inner surface of the peripheral wall 36 at several locations. The opening 22 is generally rectangular except for a U-shaped bulge 40 formed on one side thereof.

The wire harness 18 is generally conventional in construction, comprising a plurality of individual wires bundled together and terminated by the wire harness connector 20. The wire harness connector 20 has a plurality of internal chambers 42 for receiving individual wire terminals 44 (see FIG. 4) and an internally threaded nut 46 is secured to its upper surface. Four small tabs 48 project outwardly from the lower edge of the connector 20 on opposite faces thereof, one at each of its four corners.

The shroud 16 is generally funnel-shaped, having an upper end with a relatively large opening of the proper shape and size to receive the wire harness connector 20 and tapering down to a lower end with a substantially smaller opening just large enough to permit passage of the bundled wires of the harness 18. The shroud 16 may be conveniently produced as first and second halves 16*a,b* which fit together around the wire harness 18 and connector 20, the shroud halves having interlocking latching features 50 disposed thereon at several locations along the edges where the halves meet.

Figure 6:
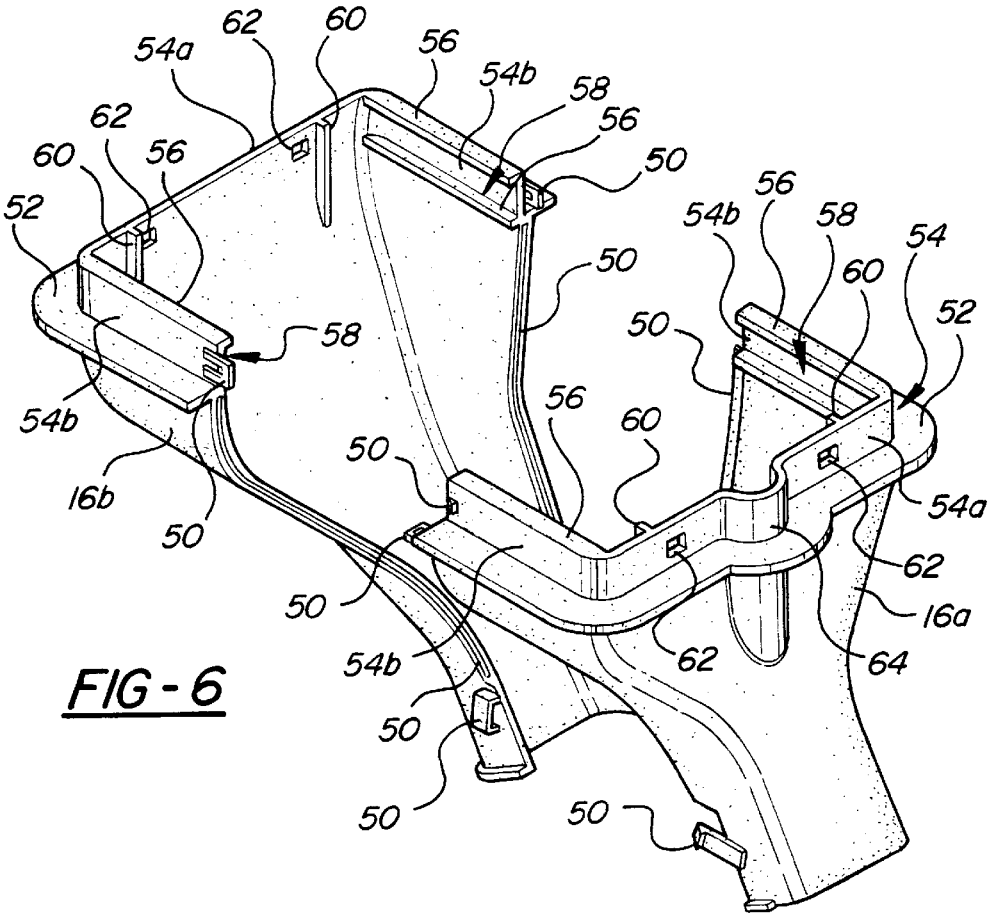
FIG. 6 is a perspective view of the two halves of the shroud.

Referring now to FIG. 6, each shroud half 16*a,b* has a lip 52 extending horizontally outward therefrom around its entire perimeter adjacent its upper edge. The portion of the shroud 16 extending above the lip 52 constitutes a flange 54 having an end wall 54*a* and opposite side walls 54*b*. Ribs 56 extend inwardly from the upper and lower edges of the flanges 54 on the side walls 54*b* of each shroud half, the upper and lower ribs defining channels 58 therebetween. A pair of vertical ridges 60 are disposed on the flange end wall 54*a* of each shroud half. A pair of latching apertures 62 are also disposed on the flange end walls 54*a*. A U-shaped bulge 64 is formed in the flange end wall 54*a* of the first shroud half 16*a*. The bulge 64 extends downwardly below the lip 52 and merges with the outer surface of the shroud 16, thus forming a vertical groove or channel in the interior of the first shroud half 16*a*.

To attach the shroud 16 to the wire harness 18, the shroud halves 16*a,b* are snapped into engagement with one another around the end of the harness 18 and wire harness connector 20 such that the tabs 48 projecting from the connector are trapped within the channels 58 formed on the flange side walls 54*b*. The tabs 48 on the wire harness connector 20 are thin relative to the height of the channels 58 so that the wire harness connector 20 is able to move relative to the shroud 16 a distance roughly equal to the height of the channels 58. The vertical ridges 60 formed on the flange 54 end walls serve to guide the movement of the wire harness connector 20 and prevent it from tilting off the axis of desired movement. The outward bulge 64 in the flange 54 of the first shroud half 16*a* provides a gap in the otherwise close fit between the shroud 16 and the wire harness connector 20. If desired, one or more wires making up the harness 18 and which are not connected with the wire harness connector 20 may be routed through this wire bypass channel as the shroud 16 halves are snapped around the connector (see FIG. 2). The wires making up the harness 18 extend downwardly from the connector 20, through the interior of the shroud 16 and exit through the lower opening.

As best seen in FIG. 3, the assembled shroud 16 is not symmetric when viewed from the side but rather extends downwardly and at an angle from the vertical, away from the end of the PDC 12 and lower housing 14 in order to route the wire harness 18 in that direction. This would be necessary, for example, if an obstruction 66 were present in the engine compartment directly below the connector 28 that would interfere with the wire harness 18. In some mounting locations it may be necessary for the shroud 16 to direct the wire harness 18 in a direction other than that shown in FIG. 3, in which case the geometry of the shroud would be altered accordingly.

It is anticipated that the shroud 16 will be assembled with the wire harness 18 and wire harness connector 20 at a location remote from the vehicle final assembly plant and shipped to the plant as a unit. The PDC 12 and lower housing 14 may be shipped to the final assembly plant as separate components or may be assembled with one another prior to shipping.

The co-joined wire harness 18, shroud 16, and lower housing 14 are attached to the PDC 12 during final assembly of the vehicle. This may be accomplished either prior to or after the lower housing 14 is secured within the engine compartment. The flange 54 of the shroud 16 is inserted into the opening 22 in the lower housing 14 until the latch projections 38 on the peripheral wall 36 snap into engagement with the latching apertures 62 in the flange 54. This secures the wire harness 18/shroud 16 assembly to the lower housing 14 and positions the wire harness connector 20 immediately below and in direct alignment with the mating connector 28 on the lower surface of the PDC 12 (see FIG. 4). In this position, the bolt 30 projecting downwardly through the PDC 12 is aligned with and rests directly on top of the nut 46 of the wire harness connector 20. Also, the lip 52 surrounding the shroud 16 closely overlays the outer surface of the lower housing 14 around the entire periphery of the opening 22 so as to effectively inhibit the entry of contaminants into the housing 14.

Figure 5:
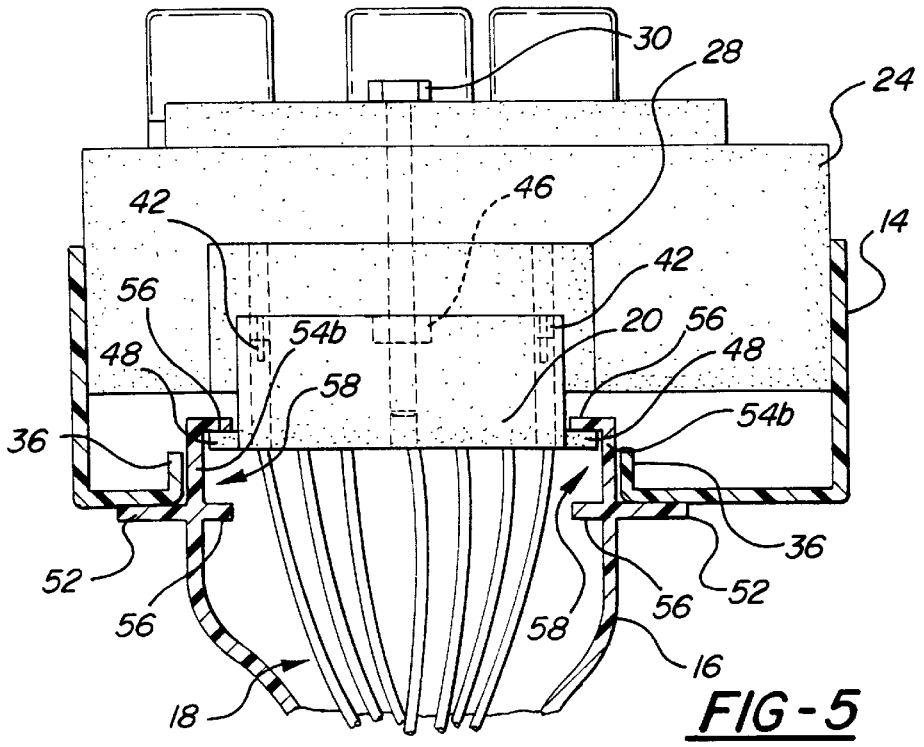
FIG. 5 is a cross-sectional view taken along line 4—4 of FIG. 1 with the wire harness connector connected with the mating connector.

To complete the electrical connection of the wire harness 18 with the PDC 12, the bolt 30 is driven into engagement with the captive nut 46 thereby drawing the wire harness connector 20 upwardly into electrical contact with the mating connector 28 (see FIG. 5). Any wires extending through the bypass channel must be separately connected to the lower surface of the PDC 12 before the PDC 12 is snapped into engagement with the lower housing 14.

The present invention allows a wire harness 18 to be quickly and conveniently mounted to the underside of a PDC 12 and provides the wire harness and its attached connector with protection against environmental contamination. The shroud 16 also guides the wire bundle in the desired direction as it extends away from the PDC 12. Since the wire harness 18 is not "hard wired" to the PDC 12, each component can be shipped as a separate item, thereby reducing the likelihood that the PDC 12 will be damaged during shipping and handling.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. Apparatus for securing an electrical wire harness and attached wire harness connector to an electrical power distribution center and a housing attached thereto, the electrical power distribution center having a mating connector for engagement with the wire harness connector, the apparatus comprising:

a shroud for surrounding the wire harness connector and an end of the wire harness adjacent to the connector, the shroud having an open first end for receiving the wire harness connector and an open second end for allowing passage therethrough of the wire harness;

means on the shroud for engaging the wire harness connector to retain the wire harness connector in connection with the shroud and allowing movement of the wire harness connector relative to the shroud along a mating axis; and means on the shroud for securing the shroud to the housing to place the wire harness connector in alignment with the mating connector along the mating axis, whereby the wire harness connector is movable along the mating axis into mating engagement with the mating connector.

2. The apparatus according to claim 1 wherein the engagement means comprises at least one channel disposed on the shroud for receiving at least one projection on the wire harness connector, the channel being sufficiently large relative to the projection to permit the projection to move therein, thereby permitting said movement of the wire harness connector along the mating axis.

3. The apparatus according to claim 1 wherein the first end of the shroud has an inner perimeter substantially matching an outer perimeter of the wire harness connector but bulging away from the outer perimeter of the wire harness connector at a location to form a wire bypass channel between the shroud and the wire harness connector at the location.

4. The apparatus according to claim 1 wherein the shroud has a relatively large opening at its first end for surrounding the wire harness connector and tapers down to a substantially smaller opening at its second end, the opening at the second end being just large enough to permit passage of the wire harness.

5. The apparatus according to claim 1 wherein the shroud comprises first and second sections and means for joining the sections with one another in surrounding relationship to the wire harness and wire harness connector.

6. The apparatus according to claim 1 wherein the securing means comprises a flange for insertion into an opening in the electrical power distribution center adjacent the mating connector, the flange having latching means for engaging complemental latching means on the electrical power distribution center.

7. The apparatus according to claim 6 wherein the engagement means comprises first and second ribs projecting from the flange to define therebetween a channel for receiving a projection on the wire harness connector, the channel being sufficiently large relative to the projection to permit movement of the wire harness connector along the mating axis between a first position wherein the wire harness connector is disengaged from the mating connector and a second position wherein the wire harness connector is matingly engaged with the mating connector.

8. Apparatus for securing an electrical wire harness and wire harness connector to an electrical power distribution center having a mating connector for engagement with the wire harness connector, the apparatus comprising:

a shroud having an open first end for surrounding the wire harness connector and an open second end for surrounding the wire harness;

a flange projecting from the first end of the shroud for insertion into an opening in the electrical power distribution center;

first and second ribs extending from the flange to define a channel therebetween for receiving a projection on the wire harness connector, the channel being of sufficient dimension relative to the size of the projection to permit movement of the wire harness connector along a mating axis between a first position wherein the wire harness connector is disengaged from the mating connector and a second position wherein the wire harness connector is matingly engaged with the mating connector; and latching means disposed on the shroud for detented engagement with complemental latching means on the electrical power distribution center, the wire harness connector being placed in alignment with the mating connector along the mating axis when the latching means is engaged with the complemental latching means.

9. In combination, an electrical power distribution center assembly and wire harness for an automotive vehicle comprising:

a housing for attachment to the vehicle and having first securing means disposed thereon;

a power distribution center secured to the housing;

an electrical connector disposed on the power distribution center;

a wire harness connector terminating an end of the wire harness, matable with the electrical connector, and having first engagement means disposed thereon;

a shroud surrounding the wire harness connector and the end of the wire harness and having second engagement means disposed thereon for receiving the first engagement means to retain the wire harness connector in movable connection with the shroud along a mating axis, and second securing means disposed thereon for receiving the first securing means to retain the shroud in connection with the housing in a position placing the wire harness connector in alignment with the electrical connector along the mating axis, whereby the wire harness connector is movable along the mating axis between a first position wherein the wire harness connector is disengaged from the electrical connector and a second position wherein the wire harness connector is engaged with the electrical connector.

10. The apparatus according to claim 9 wherein the first engagement means comprises at least one projection on the wire harness connector and the second engagement means comprises at least one channel disposed on the shroud for receiving the at least one projection, the channel being sufficiently large relative to the projection to permit the projection to move therein, thereby permitting said movement of the wire harness connector along the mating axis.

11. The apparatus according to claim 9 wherein an inner perimeter of a first end of the shroud matches an outer perimeter of the wire harness connector but bulges away from the outer perimeter of the wire harness connector at a location to form a wire bypass channel between the shroud and the wire harness connector at the location.

12. The apparatus according to claim 9 wherein the shroud has a relatively large opening at a first end thereof for surrounding the wire harness connector and tapers down to a substantially smaller opening at a second end thereof, the opening at the second end being just large enough to permit passage of the wire harness.

13. The apparatus according to claim 9 wherein the shroud comprises first and second sections and means for joining the sections with one another in surrounding relationship to the wire harness and wire harness connector.

14. The apparatus according to claim 9 wherein the first securing means comprises an opening in the electrical power distribution center adjacent the electrical connector and latching means adjacent the opening, and the second securing means comprises a flange projecting from the shroud for insertion into the opening and having complemental latching means for engaging the latching means on the electrical power distribution center.

15. The apparatus according to claim 14 wherein the first engagement means comprises a projection on the wire harness connector and the second engagement means comprises first and second ribs projecting from the flange to define therebetween a channel for receiving the projection, the channel being sufficiently large relative to the projection to permit movement of the wire harness connector along the mating axis between a first position wherein the wire harness connector is disengaged from the electrical connector and a second position wherein the wire harness connector is matingly engaged with the electrical connector.

16. The apparatus according to claim 9 further comprising means on the power distribution center for drawing the wire harness connector along the mating axis between the first and second positions.

17. The apparatus according to claim 16 wherein the means for drawing the wire harness connector comprises a threaded fastener disposed on the power distribution center engageable with a mating threaded fastener disposed on the wire harness connector.

* * * * *